United States Patent [19]

Dybvik

[11] Patent Number: 5,058,883

[45] Date of Patent: Oct. 22, 1991

[54] TETHERED SHUTTLECOCK

[76] Inventor: Burnett C. Dybvik, 301 Meadowlark Rd., St. Michael, Minn. 55376

[21] Appl. No.: 496,588

[22] Filed: Mar. 21, 1990

[51] Int. Cl.[5] ..... A63B 5/20

[52] U.S. Cl. ..... 272/93; 273/417; 273/200 R; 272/75

[58] Field of Search ..... 272/93, 74, 75; 273/416, 417, 200 R, 414, 350, 330

[56] References Cited

U.S. PATENT DOCUMENTS 4,136,866 1/1979 Bouvier ..... 272/75
4,563,002 1/1986 Jardine ..... 272/75

FOREIGN PATENT DOCUMENTS 3442742 5/1986 Fed. Rep. of Germany ..... 273/417

OTHER PUBLICATIONS

Wilson Golf Accessories—"The Gateway to Golf", p. 42, 1920.

*Primary Examiner*—Stephen R. Crow
*Attorney, Agent, or Firm*—BJNM Company

[57] ABSTRACT

An exercise and amusement device having a cord with one end attached to a handle by a stopper and clip and the other end attached to a shuttlecock by a plastic clip which engages the shuttlecock. The tethered shuttlecock provides exercise and amusement to the user. A pair of tethered shuttlecocks may be used for providing additional exercise and amusement routines.

1 Claim, 2 Drawing Sheets

TETHERED SHUTTLECOCK

BACKGROUND OF THE INVENTION

The conventional badminton game uses a shuttlecock and at least a pair of racquets for striking a shuttlecock back and forth between players. While exercise and amusement are derived from such activity, there are no devices which permit a single person to enjoy the benefits similar to badminton. Prior art devices exist which provide jump rope activity, for example, in U.S. Pat. Nos. 4,563,002 and 4,136,866. Other prior art devices have tethered soccer balls, footballs or golf balls.

It is the object of this invention to provide a shuttlecock connected to a handle by tether means for providing a unique tethered shuttlecock for exercise and amusement purposes.

SUMMARY OF THE PRESENT INVENTION

The general objective of the present invention is to enable persons of all ages to enjoy the benefits of exercise and amusement derived from a tethered shuttlecock. This device is similar to a jump rope which provides wrist rotation, but the present invention provides other exercise routines unavailable to the user of a conventional jump rope. Other exercise routines include circular motion of the shuttlecock above the user's head, figure-eight patterns, and opposite motion when using a pair of tethered shuttlecocks for developing coordination.

Creative users may discover other useful activities. Furthermore, the tethered shuttlecock may be used indoors or outdoors by persons of all ages. It can be used as a toy product which can provide a musical rhythm when employed. It can be used as an exercise device for upper body exercise of a user's shoulders, arms, and back. Walkers may use it for protection from dogs, and as night protection if provided with reflective paint.

DESCRIPTION OF THE PREFERRED EMBODIMENT

Figure 1:
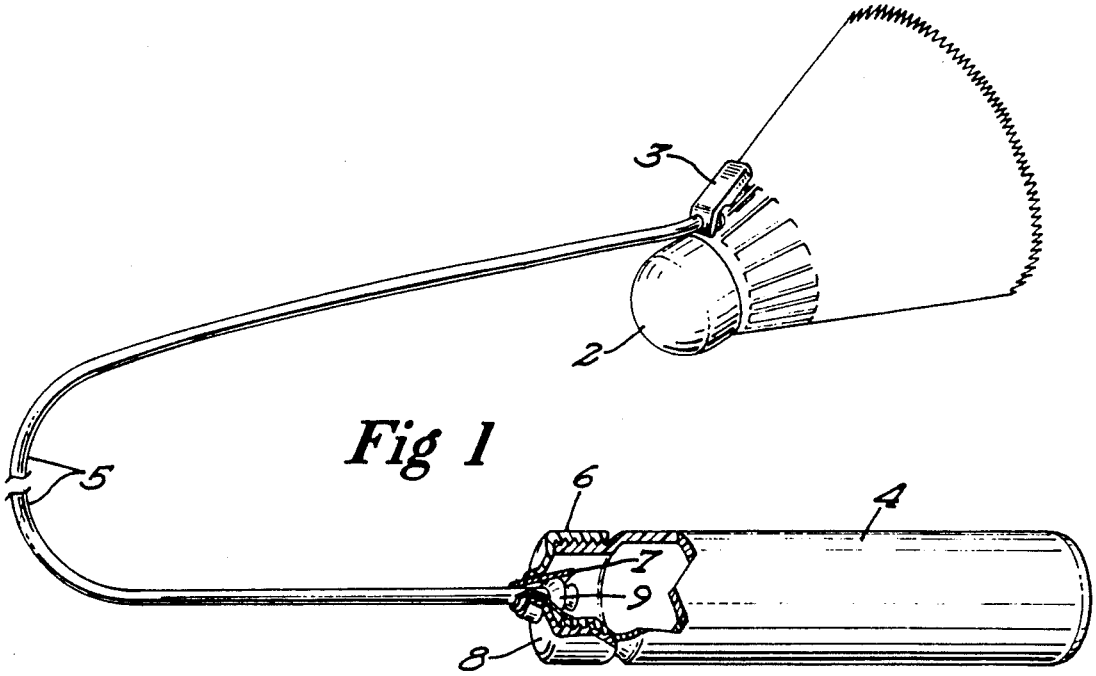
FIG. 1 is a perspective view of the tethered shuttlecock and handle.
Figure 2:
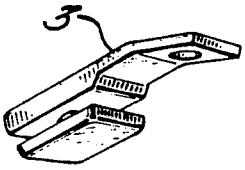
FIG. 2 shows a plastic clip for attaching a cord to the shuttlecock.

Referring to FIG. 1, the tethered shuttlecock of the invention comprises a shuttlecock 2 having a plastic clip 3, about three inches in length which is attached to the opening of the shuttlecock base by inwardly extending flanges. At the opposite end from the flanges is a hole in which a rubberized clear plastic cord 5 is threaded and attached thereto. The cord has a desired length of about four feet. At the opposite end of the cord is a clear plastic hollow handle 4 attached by threading the cord through a hole in the cap 6 of the handle and through a small cone stopper 7 which permits free rotation of the cord within the handle.

Figure 3:
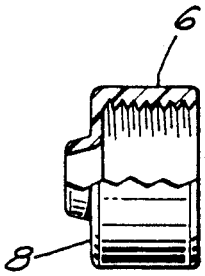
FIGS. 3–4 show respectively threaded handle cap and handle.
Figure 4:
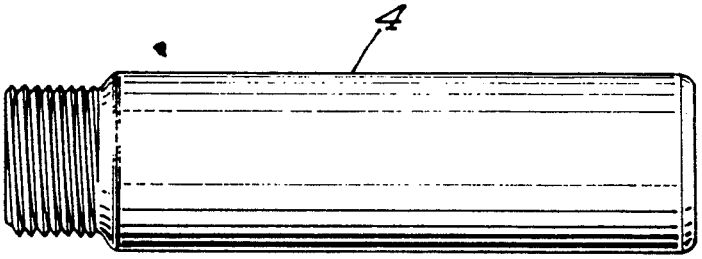
Figure 5:
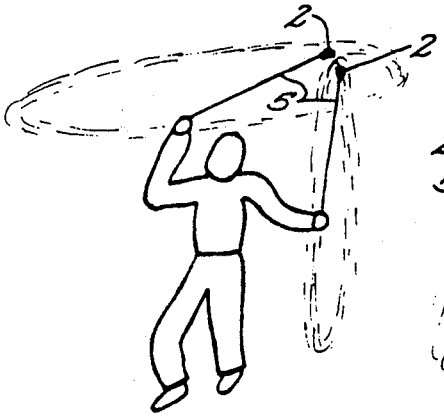
FIGS. 5–13 show various uses of the tethered shuttlecock.
Figure 6:
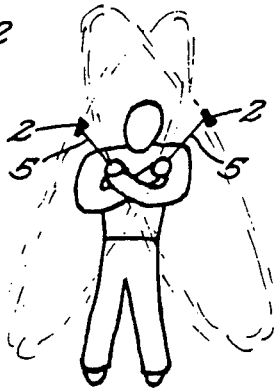
Figure 7:
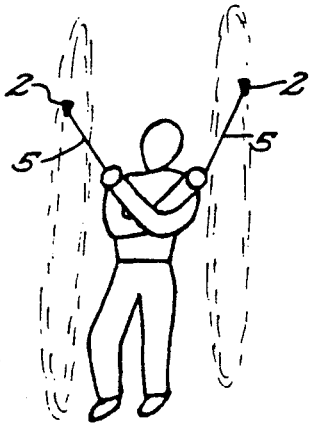
Figure 8:
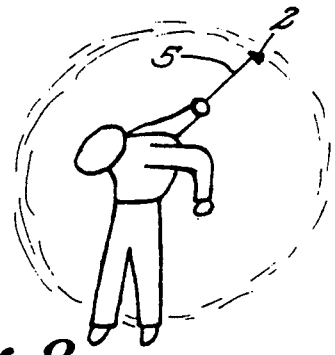
Figure 9:
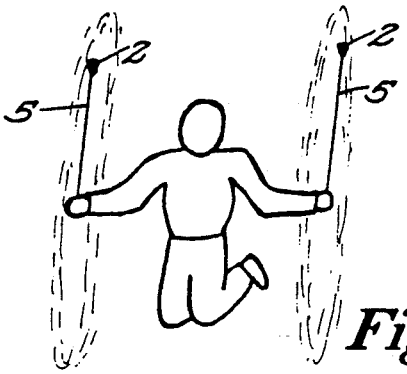
Figure 11:
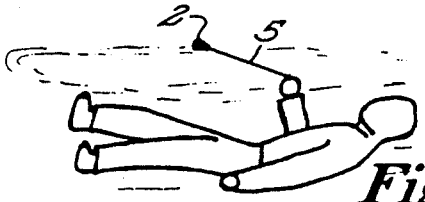
Figure 10:
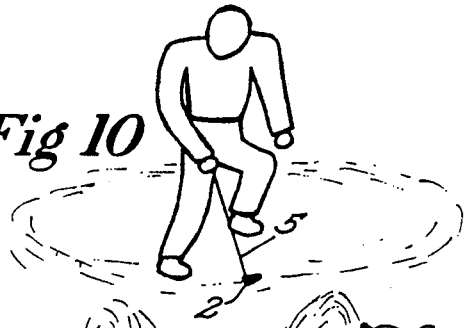
Figure 12:
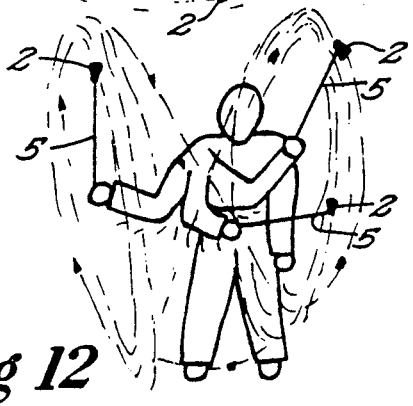
Figure 13:
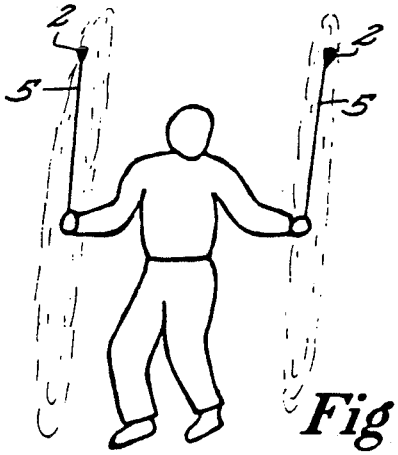

A ring 9 fastened at the end of the cord secures the stopper to the cord. The handle and cap comprise conventional threads as shown in FIGS. 3 and 4. The device is then assembled as shown in FIG. 1.

There are several advantages of the tethered shuttlecock over typical jump ropes. It is of simple and inexpensive construction and provides many exercise movements as shown in FIGS. 5–13 unattainable with conventional jump ropes.

It should be understood that the present disclosure is for the purpose of illustration, and that obvious minor changes may be made in the form and construction of the invention, without departing from the material spirit thereof.

I claim:

1. An exercising device comprising:

A. a rubberized plastic cord approximately four feet in length,

B. a plastic clip approximately three inches in length and 1 inch wide,

C. a shuttle-cock attached to one end of the cord by said plastic clip,

D. a plastic handle with a hole on one end to allow attachment to the other end of the cord for gripping by a user's hands, E. a screwable end of the handle for opening to adjust cord length, F. a small plastic cone shaped stopper approximately one inch in length which is inside said handle to allow a swivel type axis, G. a small soft metal clip around the cord inside the handle to enable cord length adjustment by cutting cord and refitting the clip which restrains the cord from slipping out of said cone shaped stopper.

* * * * *